United States Patent [19]

Saunders

[11] 4,036,056

[45] July 19, 1977

[54] SINGLE-SLIDE PRESS FOR CARRYING OUT MULTIPLE FUNCTIONS WITH A SINGLE WORK-INPUT STROKE

[75] Inventor: William T. Saunders, Weirton, W. Va.

[73] Assignee: National Steel Corporation, Pittsburgh, Pa.

[21] Appl. No.: 659,994

[22] Filed: Feb. 23, 1976

[51] Int. Cl.[2] ..... B21D 31/02

[52] U.S. Cl. ..... 72/329; 72/337; 72/347; 72/350; 113/1 G

[58] Field of Search ..... 72/329, 326, 332, 337, 72/350, 347, 344, 343, 351, 348, 349, 396, 465; 113/1 G, 7 R, 7 A, 120 H

[56] References Cited

U.S. PATENT DOCUMENTS

| | | | |
|---|---|---|---|
| 2,075,847 | 4/1937 | Hothersall | 29/513 |
| 2,150,890 | 3/1939 | Franghia | 72/348 X |
| 3,274,818 | 9/1966 | Henrickson | 72/347 X |
| 3,295,352 | 1/1967 | Middlestadt | 113/120 H |

*Primary Examiner*—James R. Duzan
*Attorney, Agent, or Firm*—Shanley, O'Neil and Baker

[57] ABSTRACT

Single-slide press with single work-input stroke and other characteristics and advantages of single-action press carries out multiple functions of double or triple-action presses in the manufacture of cup-shaped articles. A blank is cut from flat rolled sheet metal and clamped while being drawn into a cup shape; the drum cup can be redrawn into a cup of smaller diameter and greater sidewall height. Work-input force applied to the work product is modified as required for each step with fluid controlled cylinder and piston means mounted to permit relative movement of portions of the single slide means for carrying out the individual steps in sequence.

8 Claims, 8 Drawing Figures

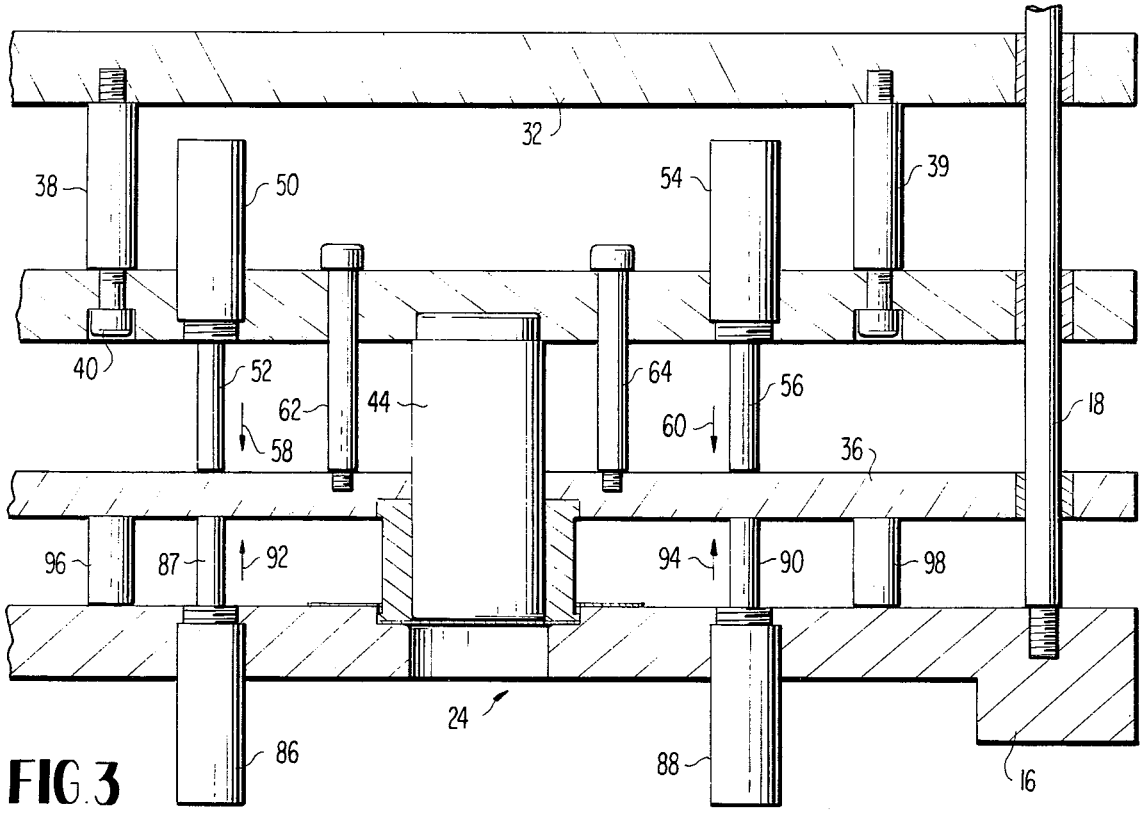
FIG. 3
FIG. 4
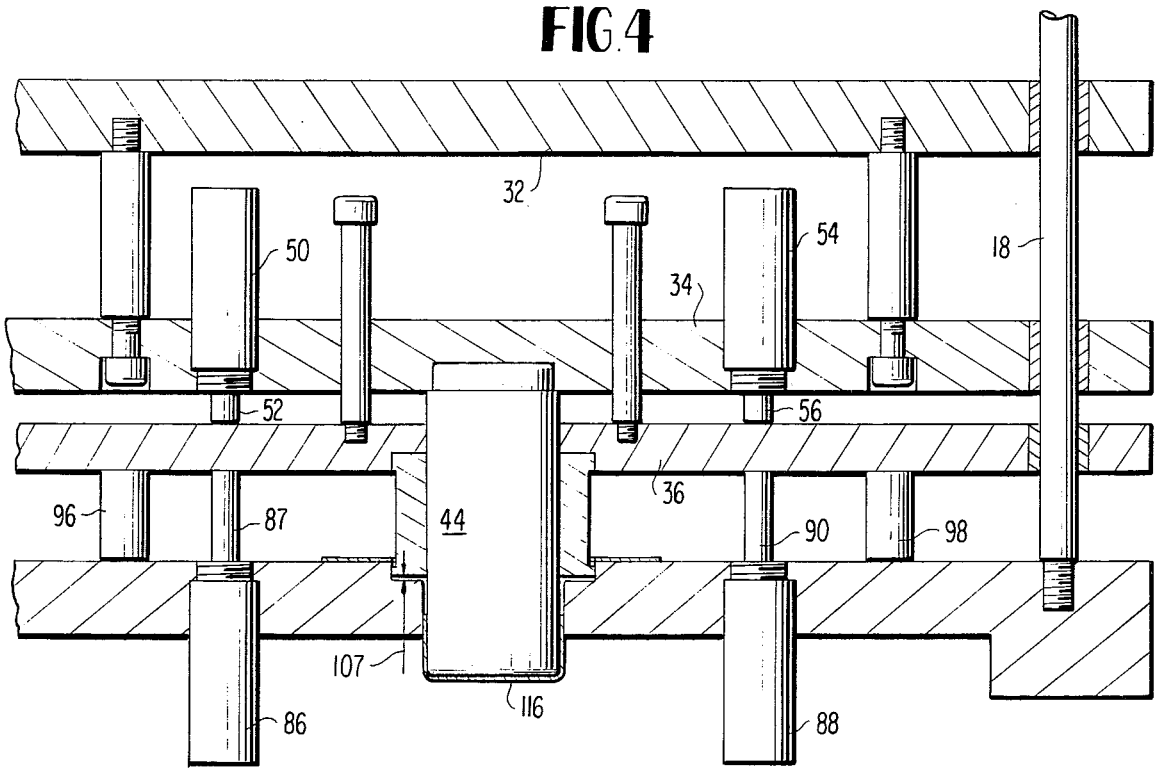

SINGLE-SLIDE PRESS FOR CARRYING OUT MULTIPLE FUNCTIONS WITH A SINGLE WORK-INPUT STROKE

This invention is concerned with single-slide press structure for manufacturing cup-shaped can bodies from flat rolled sheet metal involving multiple steps of cutting, clamping, and drawing a sheet metal blank into a cup-shaped can body carried out at differing force requirements. The invention also provides structure for carrying out additional formation steps on a drawn cup, such as a redrawing operation, as part of a single-stroke single-slide action sequence.

The basic work-input member of mechanically or hydraulically operated presses is referred to as a "slide." Such presses are frequently classified according to the number of slides incorporated in a press. Single, double, and triple-action presses are described in the "Die Design Handbook," ASTME, second Ed., published by McGraw Hill Publishing Co., Chap. 11, pp. 20–22 and Chap. 23, pp. 4–6.

The advantages of a single-action press, which include simplicity, and economy of manufacture and operation, stem from the requirement to drive only a single member. A double-action press has two slides which are separately controlled, usually from opposite sides of the product work area. Typically the double-acting press is used for drawing operations in which an outer slide carries a blank holder and an inner slide carries a punch with separate timing and movement control mechanisms for the differing slides. A triple-action press incorporates three slides having separately controlled movements which must be properly synchronized.

The primary objective of the present invention is to provide the multiple actions of a multiple slide press while maintaining the basic characteristics and advantages of a single slide press with a single work-input stroke. The steps of cutting a blank from flat rolled sheet metal, clamping the blank for drawing, and drawing the blank into a cup-shaped article are carried out by controlling movement of structures forming part of a single-slide means while modifying work-input force applied to the work product as required for individual steps.

Further, the press apparatus of the invention avoids tapering or tearing of the peripheral edge of the sheet metal which can be caused by high clamping forces per unit area at the end of a drawing step. Also, additional formation steps such as redrawing of a drawn cup can be carried out while maintaining single-slide characteristics.

Figure 1:
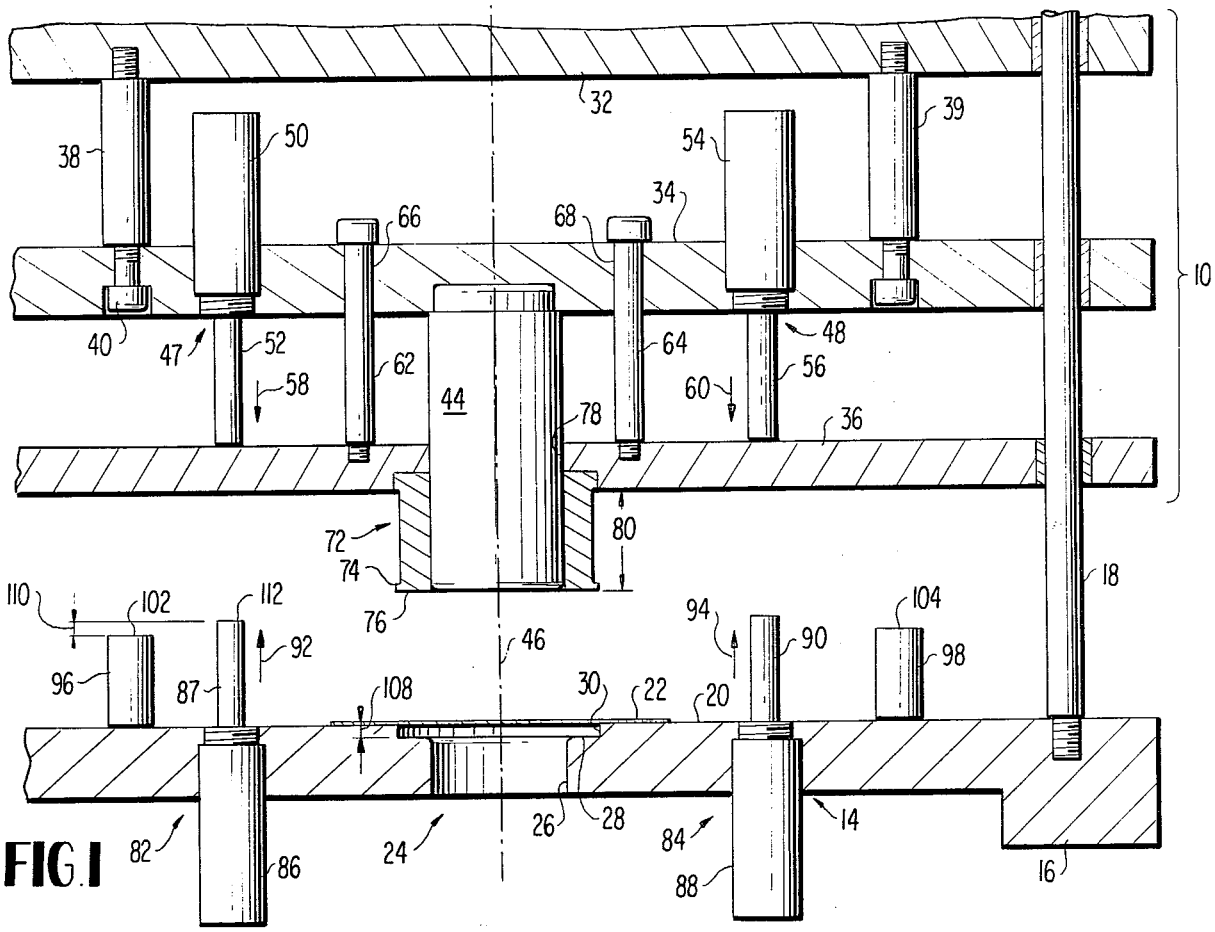
Figure 2:
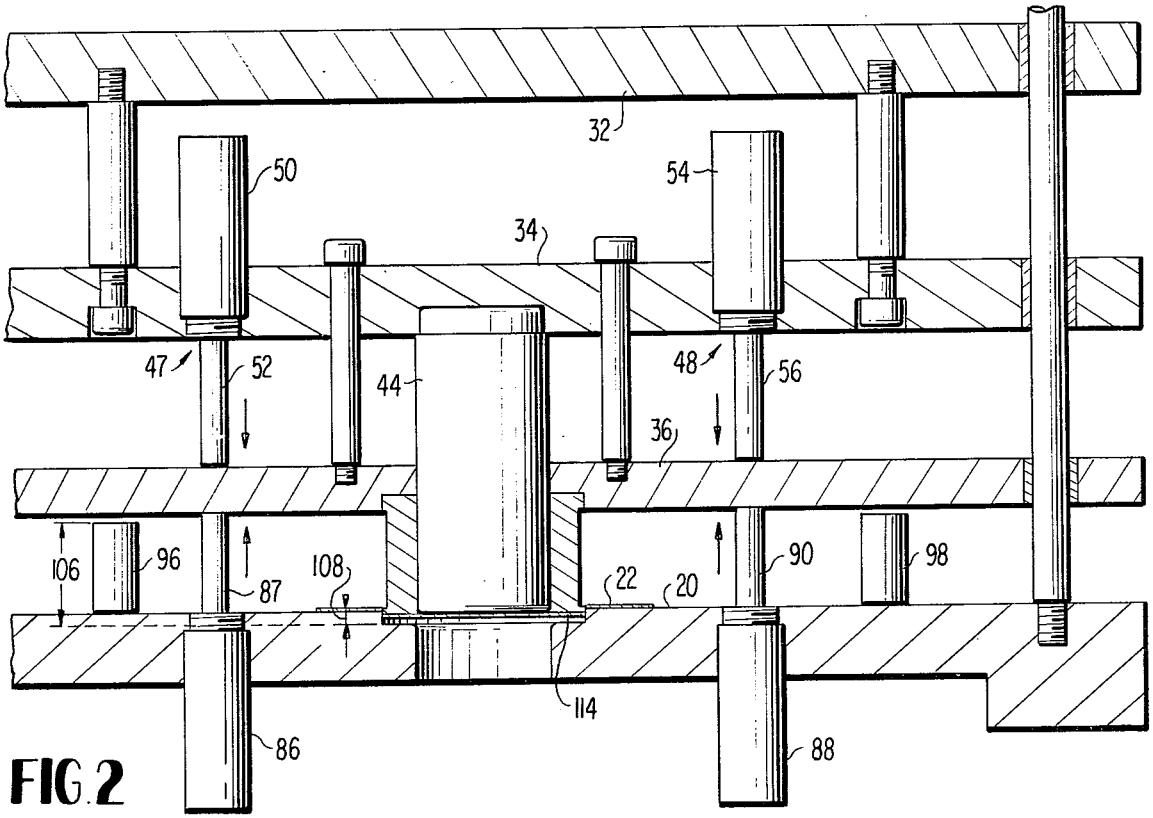
Figure 5:
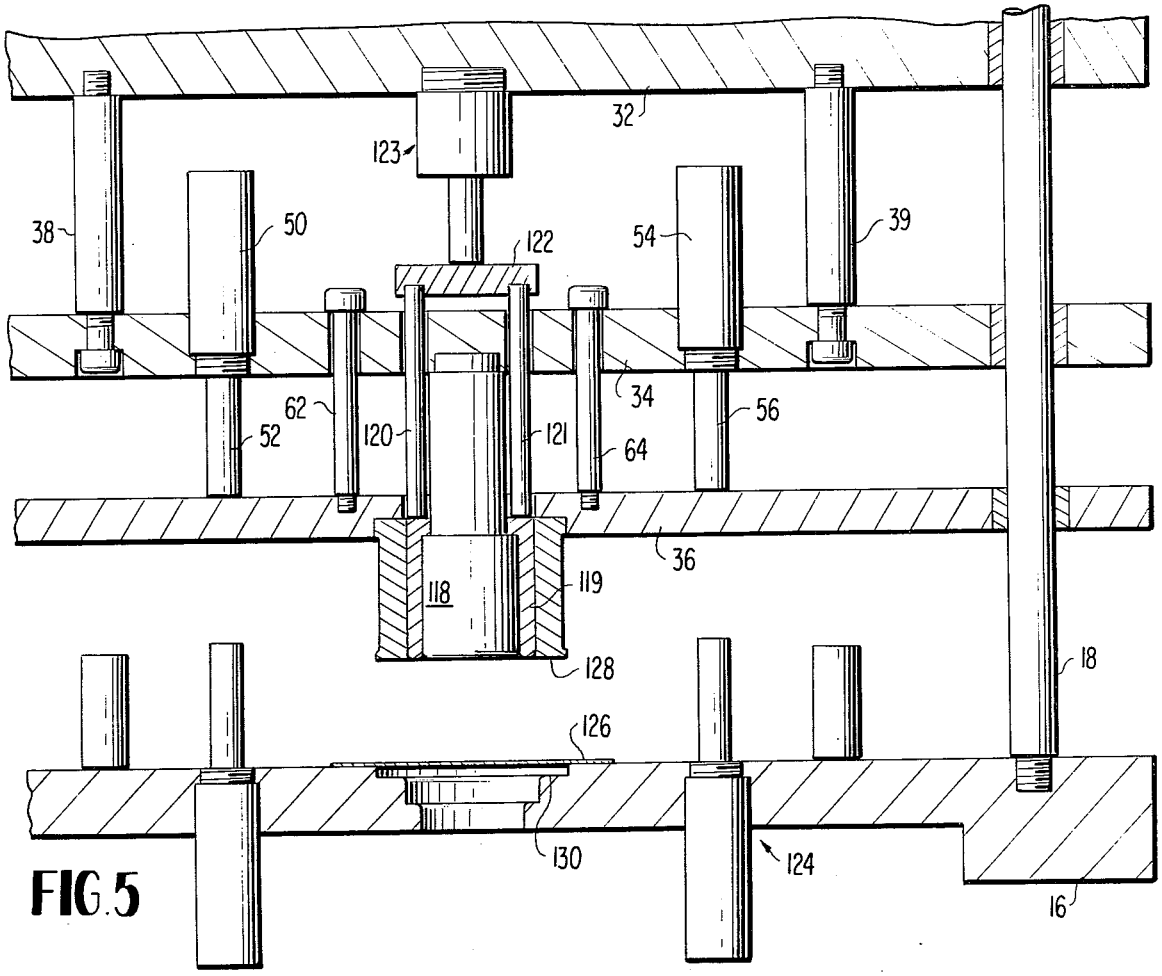
Figure 6:
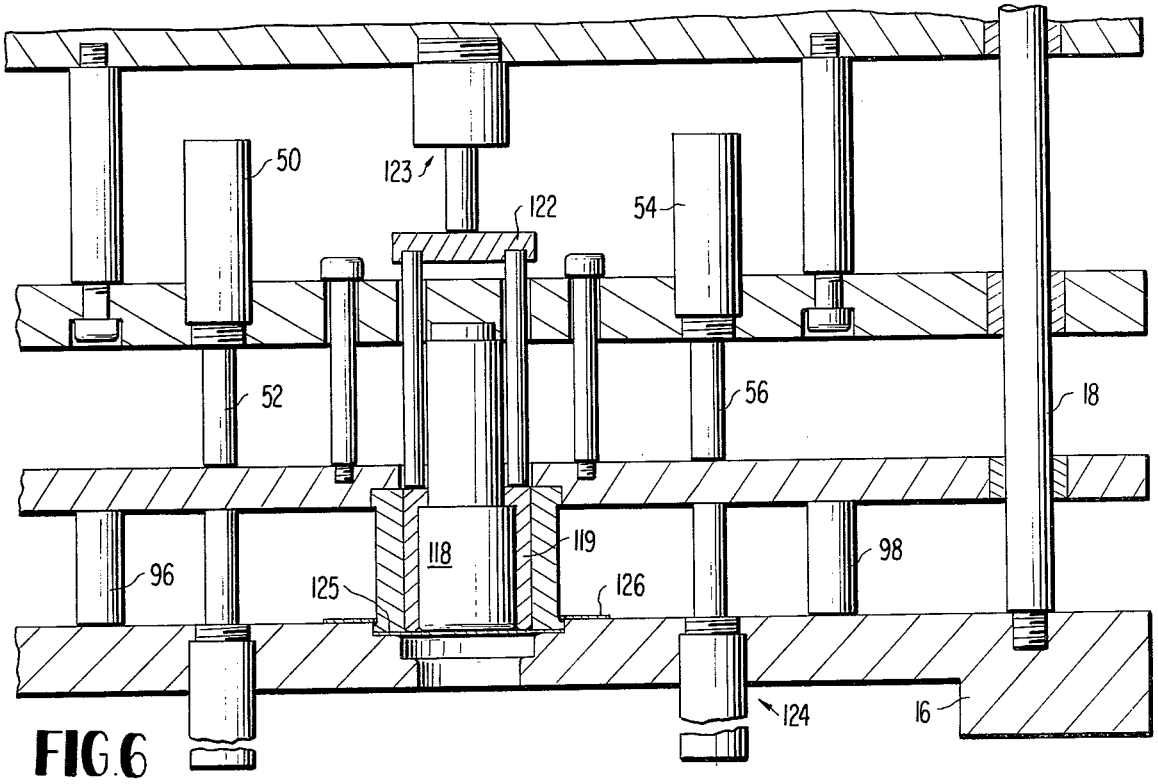
Figure 7:
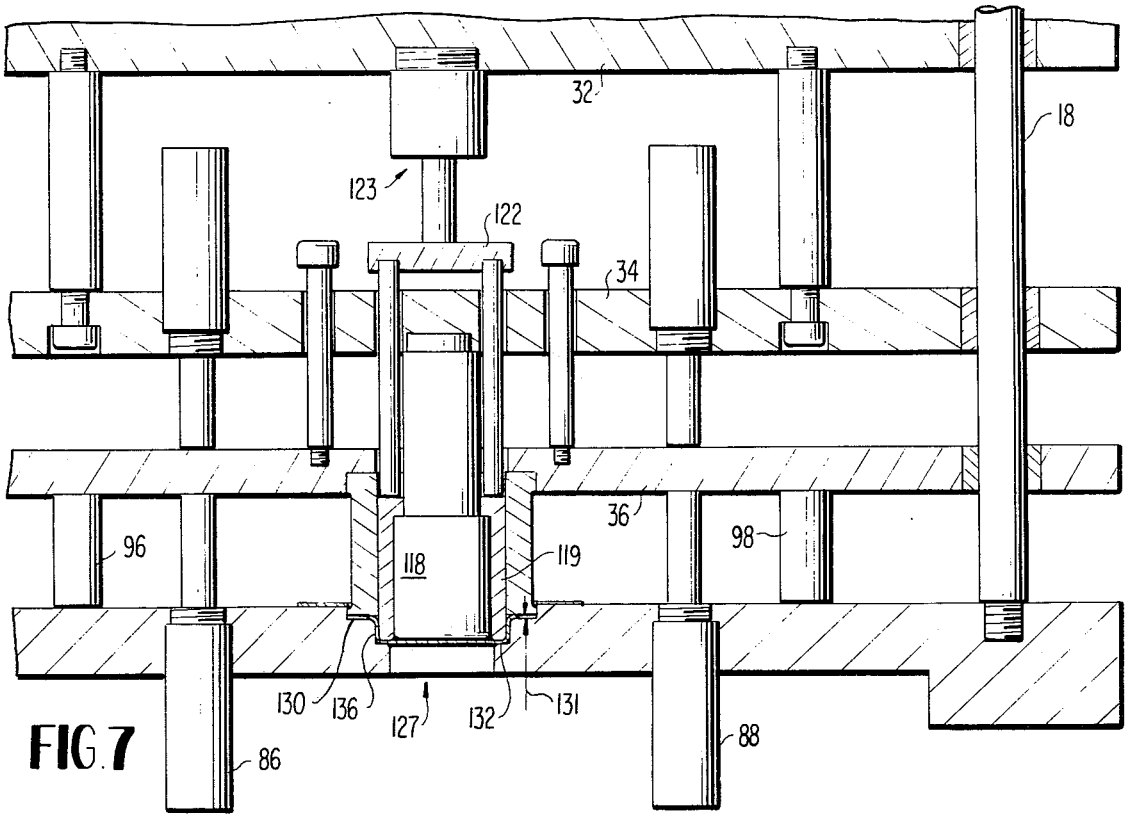
Figure 8:
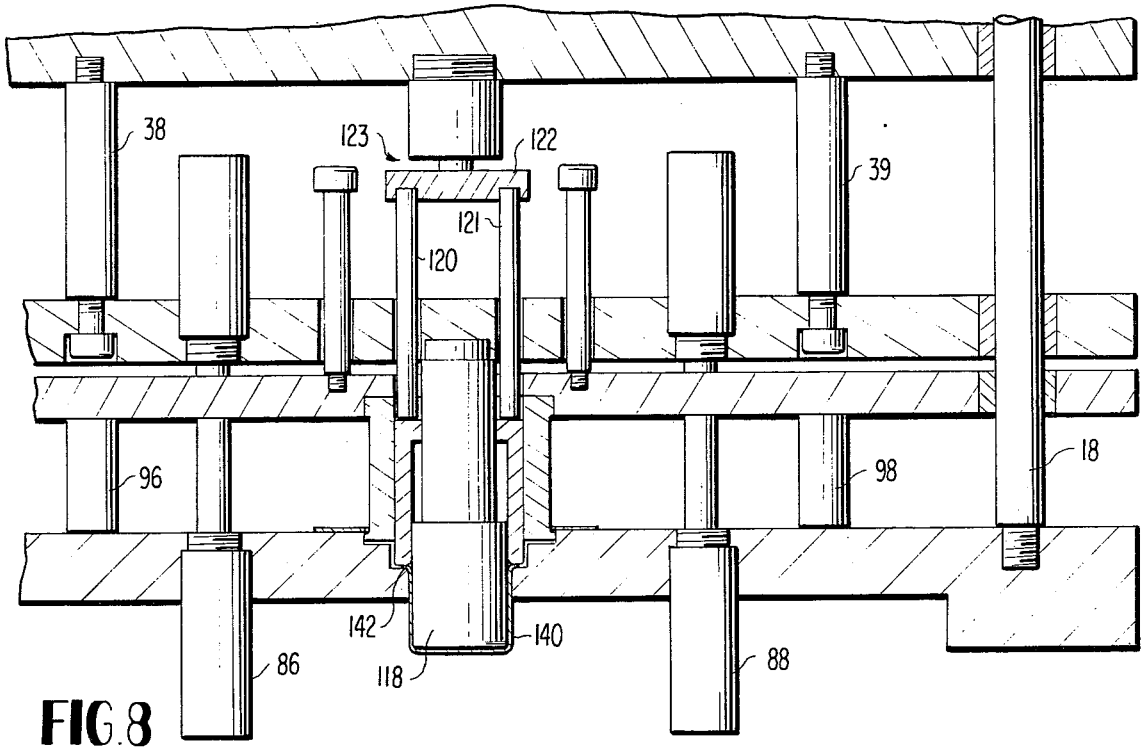

These accomplishments and other contributions of the invention will be more evident from a detailed description of apparatus embodying the invention as shown in the accompanying drawings. In these drawings:

FIG. 1 is a schematic cross-sectional view of apparatus embodying the invention immediately prior to the start of the stroke, FIG. 2 is a schematic cross-sectional view of the apparatus of FIG. 1 upon cutting of the sheet metal blank, FIG. 3 is a schematic cross-sectional view of the apparatus of FIG. 1 during clamping of the sheet metal blank and start of the draw, FIG. 4 is a schematic cross-sectional view of the apparatus of FIG. 1 following completion of the draw step, FIG. 5 is a schematic cross-sectional view of apparatus embodying the invention, prior to start of a work stroke, such apparatus including basic portions of the apparatus of FIGS. 1–4 with modifications and additions for carrying out an additional operation of redrawing a drawn cup-shaped work product as part of the single-slide action of the present invention, FIG. 6 is a schematic cross-sectional view of the apparatus of FIG. 5 during clamping after cutting of a sheet metal blank, FIG. 7 is a schematic cross-sectional view of the apparatus of FIG. 5 during drawing of a cup-shaped work product from the sheet metal blank, and FIG. 8 is a schematic cross-sectional view of the apparatus of FIG. 5 during redrawing of the drawn cup-shaped work product of FIG. 7.

In the sequence of operations performed by the apparatus of the invention, a single-slide means, with associated support structure, carrying drawing means and sheet metal cutting and clamping means moves toward a fixed bed means on which flat rolled sheet metal is disposed. A sheet metal blank is cut from the flat rolled sheet metal with the required work-input cutting force. The cut blank is then clamped with substantially reduced force while drawing of the sheet metal blank into a cup-shaped can body is carried out at substantially the full work-input force. The press includes only a single work-input stroke of a single-slide means; modification of working force experienced by the product takes place through the associated support plate structure. Thus the performance and multiple functions of a multi-action press are provided while maintaining single-action press characteristics.

Referring to FIG. 1, slide means 10 is moved longitudinally of the press toward fixed bed means 14. Frame means for the press include a foundation 16 to which the fixed bed 14 and guide means 18 for the movable slide means 10 are joined. The frame means are shown schematically on one side of the press only, it being understood that similar frame means exist on the opposite side. Typically a four poster press would be used, although other frame means are known in the art.

The fixed bed means 14 includes a work table surface 20 for supporting flat rolled sheet metal 22. Fixed bed 14 also defines female drawing structure 24 which includes a die opening 26, a female clamping surface 28 which circumscribes the die opening 26, and a female cutting edge 30 at the outer periphery of clamping surface 28.

A significant contribution of the invention involves single work-input movement of a single-slide means, with differing force requirements for particular steps resulting from modification of the full work-input force. Such force modification takes place automatically in the sequence of steps. Force modifying means comprising fluid-operated piston-cylinder means operate between structural elements of the single slide means or between such structural elements and the fixed table means to accomplish double or triple action characteristics previously available only by resorting to complex timing and coordinated input of two or three work-input slides.

Referring to FIG. 1, the single-slide means 10 is subdivided into a plurality of operative structures including a main work-input ramhead 32, a draw punch support plate 34, and a clamping plate 36. Support plate 34 is fixedly connected to ramhead 32 by connectors such as 38,39 which include adjustment means such as bolt 40 for level mounting. With the laterally oriented plate structure shown, a plurality of such connectors can be distributed about the press for proper balance and level mounting and movement. The length of connectors 38,39 can also be readily selected or changed to allow for proper clearance.

In the apparatus shown in FIGS. 1 through 4, slide means 10 includes a single male plunger 44 which is integral with support plate 34 and is mounted along the axis of symmetry 46. Clamping plate 36 is longitudinally movable relative to support plate 34 and male plunger 44.

Force modifying means 47,48 are mounted on support plate 34 and include cylinder 50 associated with piston 52, and cylinder 54 associated with piston 56. Cylinders 50,54 are secured to support plate 34 while pistons 52,56 are compressibly movable into such cylinder means. Such piston means extend longitudinally toward the fixed bed means and are movable in a direction parallel to the axis of symmetry 46. They come into contact with spaced clamping plate 36 but otherwise are not connected to such plate. Such piston means exert force as indicated by arrows 58,60; such force can be selectively controlled during the stroke. With the subdivided and spaced slide structure of the present invention such cylinder and piston force modifying means can be readily distributed about the press for proper balance and quantitative force selection for cutting and clamping; and, the concepts involved can be readily applied to multiple plunger arrangements.

Auxiliary guide means 62,64 are connected to clamping plate 36 and pass longitudinally within apertures 66,68 in draw punch support plate 34; they can determine the initial spacing and guide the relative movement between the two plate structures.

Clamping plate 36 carries male cutting and clamping tool means 72 which includes male cutting edge 74 and male clamping surface 76. The male cutting and clamping means 72 circumscribes male plunger 44 which is movable longitudinally through aperture means 78 in clamping plate 36 and through the cutting and clamping tool means 72.

The male cutting and clamping tool means 72 extends longitudinally from clamping plate 36 a pre-selected distance 80.

With work-input force applied to ramhead 32, support plate 34 and male plunger 44 move longitudinally. Pistons 52,56 are in contact with clamping plate 36 which moves with a force which can be substantially equal to the full input force of ramhead 32 for cutting a metal blank but can be modified, i.e. reduced, through force modifying means 47,48 and other means to be described.

Fixed table means 14 further includes force modifying means 82,84 comprising cylinder 86 with counterforce pin 87, and cylinder 88 with counterforce pin 90. Such pins exert force as indicated by arrows 92,94, in a direction longitudinally opposite to the direction of the work input stroke.

Also mounted on a fixed bed 14 are stop blocks 96,98 with upper surfaces 102,104 confronting clamping plate 36. As shown in FIG. 2 in relation to stop block 96, upper surface 102 is spaced from the plane of the female clamping surface 28 a preselected distance 106 having a value, greater than the longitudinal extension 80 of cutting and clamping tool means 72, which is determinative of the "controlled gap" 107 (FIG. 4) maintained to avoid tapering of edge metal as drawing is completed. The controlled gap is generally selected to be about 75% of the thickness gage of the metal being worked. For example, with flat rolled steel of thickness gage 0.013 inch (0.33 mm) the controlled gap selected would be about 0.010 inch (0.254 mm).

Female clamping surface 28 is spaced longitudinally from working table surface 20 by dimension 108 which is related to and greater than the distance 110 between the upper surface 102 of stop block 96 and the upper surface 112 of counterforce pin 87. This added depth dimension of the female clamping surface 28 is related to the gage of the sheet metal to be cut and should have a value in excess of such gage in order to permit completion of the cutting step before contact of the clamping plate 36 with the counterforce pins 87,90. Typically, dimension 110 would have a value of about 1/32 inch (0.79 mm) less than that of 108. Such would accommodate most flat rolled sheet metal gages used for can bodies and allow for reaction time of the counterforce cylinders 86,88 in order to reduce the clamping force.

As shown in FIG. 2, the entire slide means 10 has moved longitudinally toward the fixed bed 14 so as to cut blank 114 from flat rolled sheet metal 22. Such cutting force can be substantially equal to the full input force on ramhead 32 but is determined by force modifying means 47,48. After such cutting action, piston means 52,56 continues movement of clamping plate 36 so that clamping plate 36 contacts counterforce pins 88,90. and the cut blank is clamped between male clamping surface 76 and female clamping surface 28. The clamping force applied is equal to the difference between the input force indicated by arrows 58,60 of piston means 52,56 and the counterforce indicated by arrow 92,94 of pins 87,90.

As shown in FIG. 3, clamping action at reduced force responsive to the described force modifying means takes place and drawing of the cup can take place with movement of the male plunger 44 through the clamping plate 36 while maintaining desired clamping force on the sheet metal. However, in the draw stroke, the stop blocks 96,98, as shown in FIG. 4, establish the controlled gap 107 between the male clamping surface 76 and the female clamping surface 28.

Dimensionally, by way of example, such controlled gap should be around 0.002 inch (0.05 mm) less than the thickness gage of the sheet metal stock being worked in order to prevent edge feathering or tearing; i.e., working with 0.008 inch gage (0.20 mm) flat rolled stock the controlled gap should be approximately 0.006 inch (0.15 mm). The stop blocks 96,98 will limit the downward movement of clamping plate 36 to prevent edge tapering or tearing as the area of metal clamped diminishes near the end of the drawing stroke.

In FIG. 3, the sheet metal blank 114 is clamped and male plunger 44 is being moved axially with a force equal to substantially the full work-input force on ramhead 32.

In FIG. 4, drawing has progressed to completion and clamping plate 36, prior to completion of the draw, has come into contact with stop blocks 96,98 as counterforce pins 87,90 have been compressed into cylinders 86,88.

With the invention, the multiple steps of cutting, clamping, and drawing can be subdivided and carried out at differing force requirements while a single work-input movement is applied through ramhead 32 in a single-slide action. The separate force requirements are distributed by the spaced plate arrangement so that the effect on the working tooling is the same as that of separate controls, yet, no separate slides are required for the double action performed.

The force modifying and counterforce piston and cylinder means are fluid operated, e.g. nitrogen operated cylinders supplied by Hyson Fluid Power Die Equipment of Cleveland, Ohio, or Forward Industries, Inc. of Dearborn, Mich. Fluid systems can be adapted to meet the selective force requirements and dimensional requirements to carry out teachings of the invention for differing sheet metals, differing can body sizes, and work on one or more can bodies.

The apparatus of FIGS. 1–4 provides for ejection, at the end of the stroke in the same direction as that of the stroke when, e.g., the cup is to be used for subsequent sidewall ironing operations. Such bottom ejection provides significant savings in vertical spacing, travel, and clearance requirements for removal of a can body. Also with such ejection, and the subdivided, spaced plate structures of the slide means, the principles of the invention can be readily applied to further working of the can body, such as redrawing, to effect a triple action in a single-slide, single-stroke apparatus.

For conversion of the single work-input stroke, single slide press of FIGS. 1 through 4 to perform triple-action press functions, such as draw and redraw operation, the male plunger member 44 is converted to separately operable core punch 118 and ring punch 119, as shown in FIG. 5.

Ring punch 119 is connected through pin means, such as pins 120,121, to pin plate 122. Pin plate 122 is connected through fluid controlled means 123, such as a fluid operated piston and cylinder means as described previously, to ramhead 32.

Referring to sequence-of-operation FIGS. 6, 7 and 8, female draw and redraw die means are mounted in fixed bed 124 in axial alignment with the male draw ring punch 119 and the redraw core punch 118. In FIG. 6, blank 125 has been cut from sheet metal 126 and clamped as described earlier in relation to FIGS. 2 and 3.

Referring to FIG. 7, the first draw in female die means 127 is being completed by ring punch 119 while blank 125 is clamped between male clamping surface 128 and female clamping surface 130; controlled gap 131 is maintained between these two surfaces by stop blocks 96,98. Upon completion of that draw, that portion of the sheet metal of the drawn cup beneath ring punch 119 will be in contact with redraw clamping surface 132 which stops the forward motion of ring punch 119. The ring punch 119, under the controlled pressure of force modifying means 123 then acts as a clamping means for drawn cup 136 during the redrawing operation.

Referring to FIG. 8, male core punch 114 has been moved into female redraw die opening 138, decreasing the diameter and elongating the sides of the drawn cup 136. As shown, redrawn cup 140 can be left with flange metal 142 for a chime seam. In such case cup 140 is not bottom ejected but is removed in the direction of retraction of the male punch means 118,119.

Carrying out these steps with the structure shown enables a press with a single-slide means to provide the services of a triple-action press; there include cutting of a blank, clamping of the blank for drawing, drawing the blank into a cup-shaped article, clamping the drawn cup, and redrawing of the first drawn cup into an extended height cup 140 as shown in FIG. 8.

It should be noted that the principles taught by the invention can be used to increase the number of actions carried out by a single or multi-action press without the addition of separate slides or separate slide movement controls. Other dispositions for interrelation of the force modifying means and subdivided structural elements to carry out the various actions can be devised in the light of the present teachings, therefore the scope of the present invention is to be determined from the appended claims.

What is claimed is:

1. Apparatus for use in the manufacture of a cup-shaped can body from flat rolled sheet metal, which manufacture embodies multiple step operations carried out at differing force requirements including at least the steps of cutting a sheet metal blank, clamping the sheet metal blank for drawing, and drawing the sheet metal blank into a cup-shaped can body, comprising press means having single slide characteristics capable of carrying out such multiple step operations with a single work-input stroke, such press means including:

frame means defining a longitudinal axis of symmetry for the press means, fixed bed means, and a single, work-input, movable slide means, such slide means being movable toward the fixed bed means in a direction parallel to the longitudinal axis of symmetry, the fixed bed means including:

a work table surface for supporting flat rolled sheet metal from which a blank is to be cut, such work table surface lying in a plane perpendicular to the longitudinal axis of symmetry, female cutting edge means for cutting a blank from flat rolled sheet metal supported on the work table means, female drawing die means defining at least one female drawing die opening having a longitudinal axis parallel to the axis of symmetry of the press means and circumscribed by the female cutting edge means, female clamping surface means for a cut sheet metal blank, located intermediate the female die opening and the female cutting edge means, such clamping surface means lying in a plane perpendicular to the axis of symmetry of the press means, and counterforce means located to exert force in a direction parallel to such axis of symmetry and opposite to the direction of movement of such slide means toward the fixed bed means;

the single, work-input, movable slide means being subdivided into interrelated substructures including:

a draw punch support plate mounted for movement with such slide means and extending laterally in generally perpendicular relationship to the axis of symmetry of the press, a clamping plate in longitudinally spaced relationship from the support plate and extending laterally in generally perpendicular relationship to the axis of symmetry, the clamping plate being mounted for movement with such slide means and for relative longitudinal movement with respect to such support plate, and male draw punch means mounted on the support plate for movement parallel to the longitudinal axis of the press means, such male draw punch means comprising at least one male plunger, the clamping plate defining aperture means for longitudinal passage of such male plunger, male cutting and clamping structure mounted on the clamping plate means to extend longitudinally in the direction of the female cutting and clamping means, the male cutting and clamping structure including male cutting edge means circumscribing a male clamping surface means, the male clamping surface means lying on a plane perpendicular to the axis of symmetry of the press means and being in circumscribing relationship to the male plunger, force modifying means connected to such support plate and extending longitudinally toward and contacting the clamping plate to modify the force exerted by the male cutting and clamping structure supported on the clamping plate, such force modifying means exerting a selected force in parallel ralationship to the axis of symmetry, the selected force having a direction which is the same as the direction of movement of the slide means toward the fixed bed means, such male plunger, support plate with force modifying means, and the clamping plate with male cutting and clamping structure being movable longitudinally toward the work table means with the male cutting edge means and clamping surface means positioned to contact flat rolled sheet metal supported on the work table surface and, after cutting of a sheet metal blank with a selected force, clamp the sheet metal blank with a force less than such selected cutting force as the clamping plate contacts the counterforce means of the fixed bed means, the counterforce means permitting longitudinal movement of the clamping plate and the male clamping surface means in the direction of movement of the slide means toward the fixed bed means at such reduced force, means for limiting longitudinal movement of the clamping plate to a pre-selected distance related to the thickness gage of such sheet metal blank, with such male plunger being movable longitudinally into and through the female drawing die opening with ejection of the drawn cup-shaped can body being in the direction of movement of such slide means toward the fixed bed means.

2. The apparatus of claim 1 in which the means for limiting longitudinal movement of the clamping plate comprises stop block means extending from the work table means toward the slide means;

with such pre-selected distance movement of the clamping plate toward the fixed bed means being limited by contact of the clamping plate with the stop block means mounted on the fixed bed means such stop block means maintaining a minimum clearance for sheet metal between such male and female clamping surface means during drawing of the cup-shaped can body to prevent tapering of peripheral edges of such sheet metal blank as drawing of such cup-shaped can body is completed.

3. The apparatus of claim 1 in which the slide means includes a work-input ramhead with the support plate being spaced longitudinally from and fixedly secured to such ramhead, and in which the force modifying means comprise fluid-operated cylinder means secured to the plate support, and piston means movable into such cylinder means, the piston means extending toward and contacting the clamping plate.

4. The apparatus of claim 1 in which such counterforce means comprise fluid operated cylinder means fixedly mounted with relation to the fixed bed means, and piston means extending longitudinally toward the clamping plate, such counterforce piston means being movable into such counterforce cylinder means under preselected force applied through contact with the clamping plate.

5. The apparatus of claim 3 for use in redrawing of the drawn cup-shaped article in which the male plunger comprises a core punch, and a ring punch in circumscribing relationship to the core punch, such core punch and ring punch being relatively movable with respect to each other.

6. The apparatus of claim 5 in which the core punch is secured to the support plate, and the ring punch is selectively actuated by additional force modifying means connected to the work-input ramhead.

7. The apparatus of claim 3 for use in redrawing the drawn cup-shaped article in which the female drawing die means includes a female redrawing die opening longitudinally spaced from the female drawing die opening in the direction of movement of the slide means toward the fixed bed means, and in which such male plunger comprises a ring punch and a cylindrical core punch, the ring punch being in circumscribing relationship to such core punch, the ring punch being longitudinally insertable into the female drawing die opening for drawing a cup-shaped can body, and the core punch being longitudinally insertable into the female redrawing die opening for redrawing such cup-shaped can body.

8. The apparatus of claim 7 in which the cylindrical core punch is secured to the draw punch support plate so as to move with the slide means, the ring punch means includes clamping surface means at its work-output longitudinal end, and the ring punch is operated by fluid operable cylinder means secured to the work-input ramhead so as to limit operation of the ring punch to drawing of the cup-shaped article and clamping of such drawn cup-shaped article during its redraw which takes place by movement of the core punch into the female redrawing die opening.

* * * * *